United States Patent [19]

Burns, Sr. et al.

[11] Patent Number: 5,044,434

[45] Date of Patent: Sep. 3, 1991

[54] LONG STROKE PACKER

[75] Inventors: Timothy D. Burns, Sr.; Kenneth D. Caskey; Donald W. Winslow, all of Duncan, Okla.

[73] Assignee: Halliburton Company, Duncan, Okla.

[21] Appl. No.: 494,718

[22] Filed: Mar. 16, 1990

[51] Int. Cl.[5] ..... E21B 33/128; E21B 33/129

[52] U.S. Cl. ..... 166/129; 166/138; 166/183; 166/196

[58] Field of Search ..... 166/138–140, 166/129, 130, 183, 134, 120, 73, 118, 196

[56] References Cited

U.S. PATENT DOCUMENTS

| | | | |
|---|---|---|---|
| 3,094,169 | 6/1963 | Conrad | 166/134 |
| 3,603,388 | 9/1971 | Current et al. | 166/120 |
| 3,684,010 | 8/1972 | Young | 166/139 X |
| 3,785,436 | 1/1974 | Davis, Jr. | 166/120 |
| 4,605,062 | 8/1986 | Klumpyan et al. | 166/129 X |
| 4,619,319 | 10/1986 | Ringgenberg | 166/129 X |
| 4,671,352 | 6/1987 | Magee, Jr. et al. | 166/129 X |

OTHER PUBLICATIONS

Halliburton Services Sales & Service Catalog No. 43, published in 1985, pp. 2563–2565.

*Primary Examiner*—Hoang C. Dang

*Attorney, Agent, or Firm*—James R. Duzan; Neal R. Kennedy

[57] ABSTRACT

A long stroke packer for use in a well bore. The packer has a housing assembly with an operating mandrel assembly disposed therein. A packer mandrel assembly is slidably connected to the housing assembly. During operation, the operating mandrel assembly may be actuated to cycle a tool below the packer without setting the packer. After the operating mandrel assembly and housing assembly are moved a predetemined amount with respect to the packer mandrel assembly, the housing assembly is brought into contact with a sliding shoe on the packer mandrel assembly which in turn engages and deforms packer elements into sealing engagement with the well bore.

18 Claims, 5 Drawing Sheets

LONG STROKE PACKER

BACKGROUND OF THE INVENTION

1. Field Of The Invention

The present invention relates to packers for use in well bores, and more particularly, to a packer which allows manipulation of a tool below the packer by some reciprocation of the tool string without setting the packer.

2. Description Of The Prior Art

A multiple purpose retrievable packer designed for testing, treating and squeezing operations in a well bore is the Champ® III packer. This packer is set by turning the work string to the right and setting down weight. Pressure applied below the packer forces hydraulic holddown slips against the casing. This helps prevent the packer from being pumped up the well bore. A straight upward pull releases the packer.

A concentric bypass is built into the Champ® III packer, and this allows the fluid to bypass between two concentric mandrels, requiring all circulated fluid to go around the bottom of the packer. The bypass is locked in the open position and cannot close until the setting action engages the lower mechanical slips. A large area through the bypass allows the packer to be run with a minimum of pressure surges being created. A pressure balancing system helps prevent the bypass from being pumped open.

The Champ® III packer has a relatively short setting stroke, and a portion of the outer housing forms an upper packer shoe. When weight is set down, the bypass is closed, and the shoe is forced downwardly against the packer elements squeezing them outwardly into a sealing position. At approximately the same time, the mechanical slips are forced outwardly to grippingly engage the well bore. Because of the relatively short setting stroke, manipulation of certain tools such as the Halliburton Services FO Frac System is not possible with this packer. Accordingly, there is a need for a packer such as the Champ® III packer with a relatively longer stroke which allows some manipulation of the tool string to actuate certain tools below the packer.

The long stroke packer of the present invention meets the above-described need by providing a modification of the Champ® III packer and adds length to the setting stroke thereof.

SUMMARY OF THE INVENTION

The long stroke packer of the present invention is adapted for use in a well bore and comprises a housing or housing assembly, a packer mandrel or packer mandrel assembly slidably disposed with respect to the housing, an operating mandrel or operating mandrel assembly slidably disposed in the housing and packer mandrel and adapted for connection to a tool string, packer means disposed on the packer mandrel for sealingly engaging the well bore when in a set position, and a packer shoe slidably disposed on the packer mandrel between the housing and packer means. The shoe is adapted for contact by a portion of the housing during a setting operation whereby the shoe is moved against the packer means for setting thereof into sealing engagement with the well bore. The contact of the packer shoe by the housing occurs after a predetermined relative longitudinal movement between the housing and packer mandrel. This allows partial reciprocation of the operating mandrel and the housing as necessary, for actuating a tool which may be positioned below the packer, but without setting the packer.

The packer preferably further comprises means for preventing relative rotation between the housing and packer mandrel. This means for preventing relative rotation may comprise one of the housing and the packer mandrel having lug means thereon, or extending therefrom, and the other of the housing and packer means having receiving means thereon for receiving the lug means and providing sliding engagement therebetween. In the illustrated embodiment, the lug means is characterized by a lug or external spline on the packer mandrel, and the receiving means is characterized by a slot or internal spline in the housing.

The packer mandrel comprises a shoulder adjacent to the shoe so that relative upper movement thereof is prevented beyond the shoulder. The shoe is positioned adjacent to the packer means, and in the illustrated embodiment, is located between the shoulder and the packer means.

The packer further comprises mechanical slip means for grippingly engaging the well bore when in a set position, a drag block or drag block assembly for engaging a liner portion of the well bore and allowing relative movement between the housing and the operating mandrel, and hydraulic slip means for preventing upward movement of the packer in the event of increased pressure below the packer. The packer may also comprise bypass means for bypassing fluid through the packer when it is run into the well bore.

The present invention also includes a downhole tool comprising a tool such as a fracturing tool having an operating cycle with the packer disposed above the fracturing tool. The operating mandrel in the packer is reciprocable an amount sufficient for cycling the fracturing tool without setting the packer and is further reciprocable for placing the packer in the set position. After setting the packer, the operating mandrel is reciprocable an amount sufficient for additional cycling of fracturing tool without unsetting the packer, and the operating mandrel is further reciprocable for releasing the packer from the set position.

It is an important object of the present invention to provide a packer set by reciprocation of the tool string and having a relatively long setting stroke.

It is another object of the invention to provide a packer with sufficient length in its setting stroke so that it is possible to actuate tools below the packer by manipulation of the tool string without setting the packer.

It is a further object of the invention to provide a modification of the Halliburton Services Champ® III packer which adds length to the setting stroke thereof.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
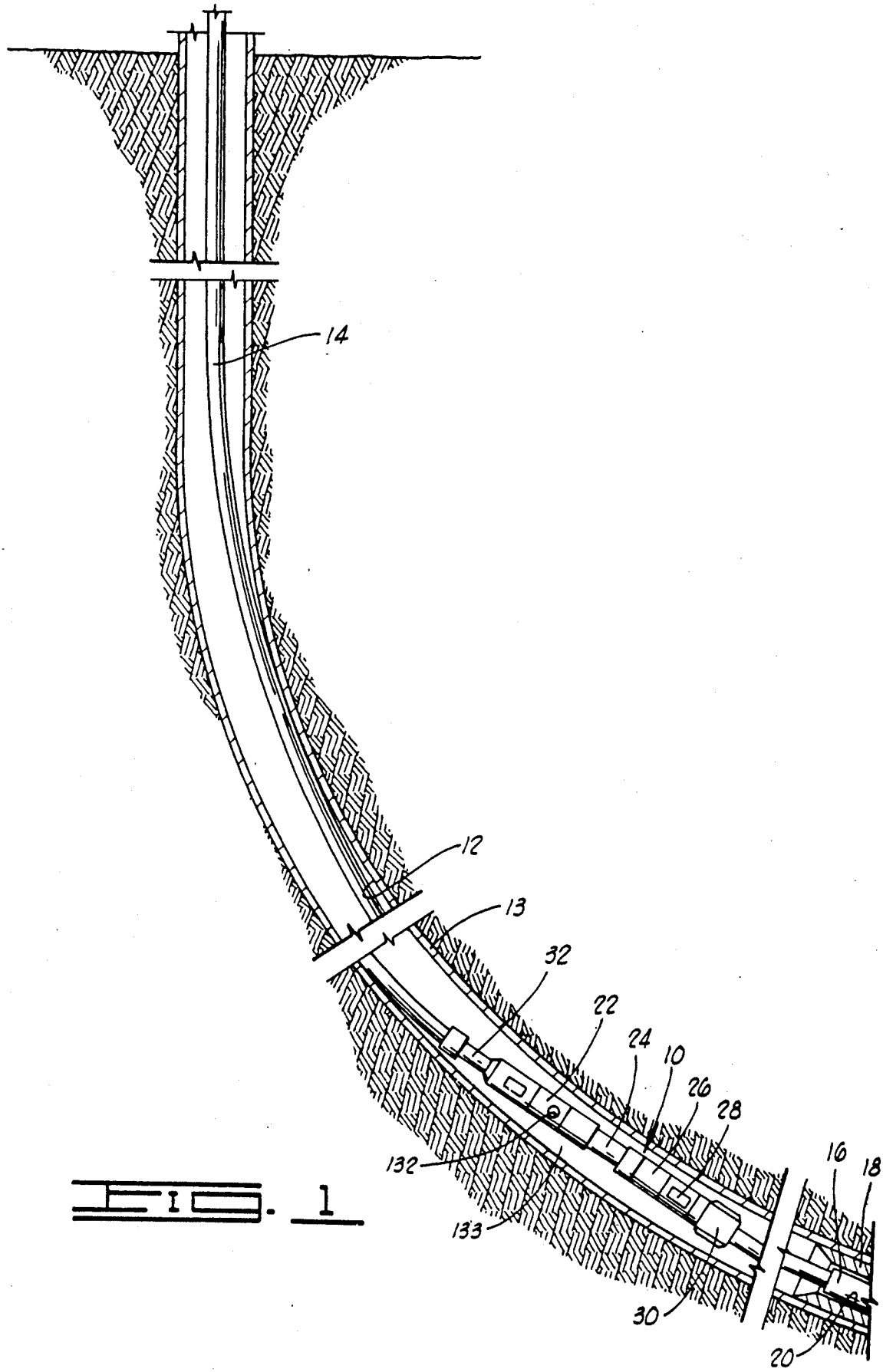
FIG. 1 illustrates the long stroke packer of the present invention as it is run into a well bore on a tool string.

Referring now to the drawings, and more particularly to FIG. 1, the long stroke packer of the present invention is shown and generally designated by the numeral 10. Packer 10 is positioned in a well bore 12, generally defined by casing 13, at the end of a tool string 14. As seen in FIG. 1, well bore 12 may be deviated. Another tool or tools 16, such as the Halliburton Services FO Frac System, may be disposed below packer 10. As will be further described herein, packer 10 is designed for use with any tool which requires actuation by manipulation of the tool string without setting the packer, and it is not intended that the invention be limited to any particular tool below the packer. Packer 10 is eventually positioned in a liner portion 18 of well bore 12, and when set, packer 10 is in gripping and sealing engagement with bore 20 of liner 18.

Packer 10 includes an outer housing assembly 22 with a packer mandrel assembly 24 slidably connected thereto. Packer means, such as packer elements 26, and a mechanical slip assembly 28 are disposed on packer mandrel assembly 24. A drag block assembly 30 is attached to the lower end of packer mandrel assembly 24. An operating mandrel assembly 32 is attached to tool string 14 and is slidably disposed in housing assembly 22, packer mandrel assembly 24 and drag block assembly 30.

Referring now to FIGS. 2A–2G, the details of long stroke packer 10 will be discussed. At the upper end of packer 10, and forming the upper portion of operating mandrel assembly 32, is a top adapter 34. Top adapter 34 has a threaded bore 36 adapted for connection to tool string 14. Top adapter 34 is attached to upper mandrel 38 at threaded connection 40. A sealing means, such as O-ring 42, provides sealing engagement between top adapter 34 and upper mandrel 38. Upper mandrel 38 has a first outside diameter 44 below threaded connection 40.

Upper mandrel 38 extends into hydraulic body 46 which forms the upper portion of housing assembly 22. Hydraulic body 46 has a first bore 48 therein which is in close, spaced relationship to first outside diameter 44 of upper mandrel 38. A sealing means, such as a plurality of O-rings 50, provides sealing engagement between upper mandrel 38 and hydraulic body 46. Hydraulic body 46 also defines a second bore 52 therein which is slightly larger than first bore 48.

Figure 2A:
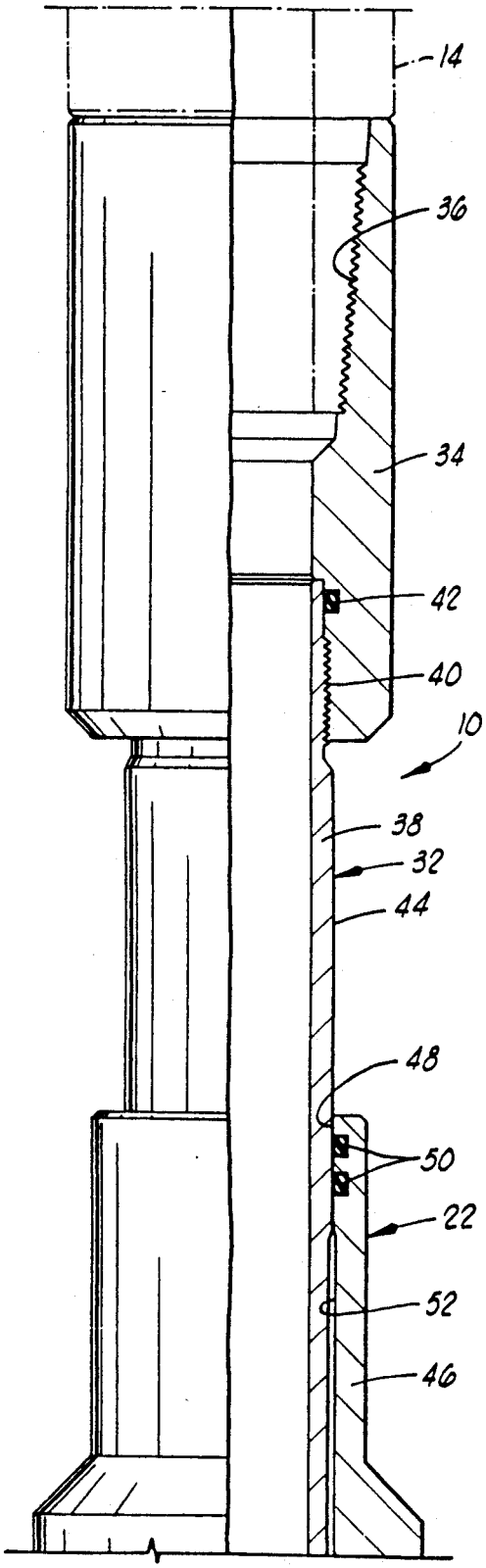
FIGS. 2A–2G show elevation and cross-sectional details of the long stroke packer.
Figure 2B:
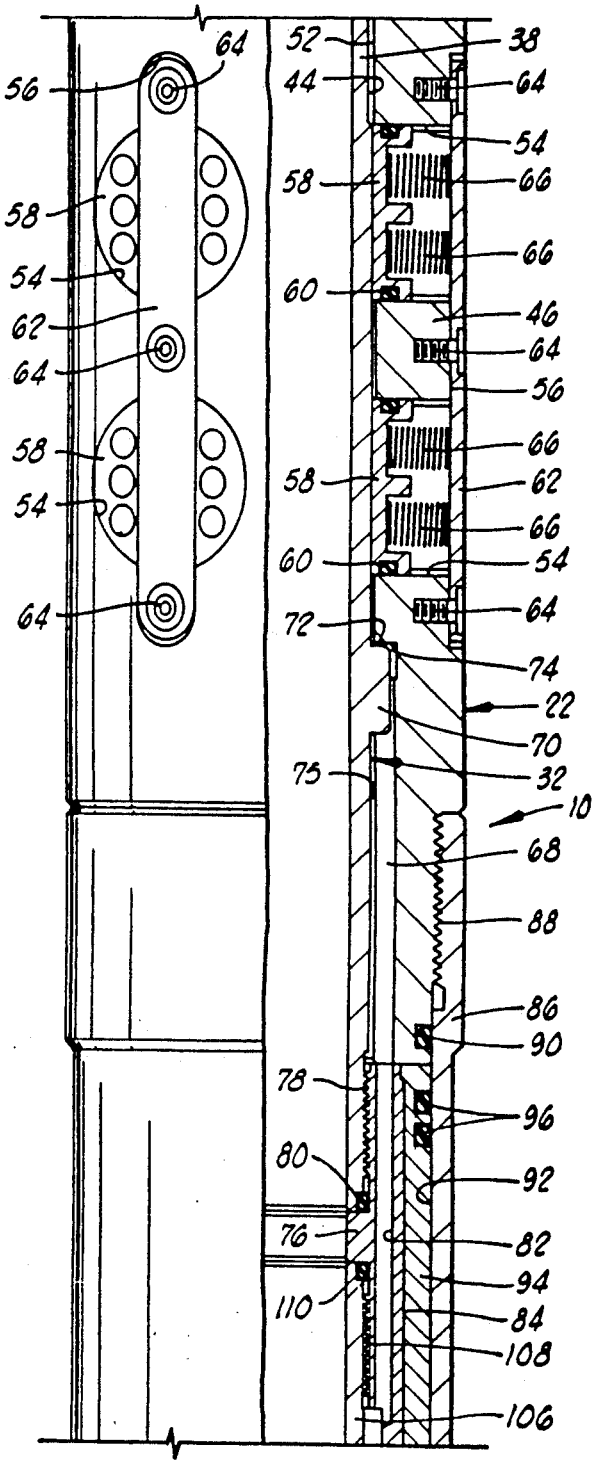

Referring now to FIG. 2B, hydraulic body 46 defines a plurality of transverse openings 54 therein. An elongated recess 56 extends longitudinally along the outer surface of hydraulic body 46 and spans adjacent pairs of openings 54.

Disposed in each opening 54 is a hydraulic slip 58. A sealing means, such as O-ring 60, provides sealing engagement between each hydraulic slip 58 and a corresponding held in place by bolts 64. Holding strap 62 retains hydraulic slips 58 in openings 54. A biasing means, such as a plurality of springs 66, is disposed in each opening 54 between holding strap 62 and the corresponding hydraulic slip 58 to bias the hydraulic slip radially inwardly toward inner mandrel 38.

At the lower end of hydraulic body 46 is a lug receiving means, such as a longitudinally extending internal slot or internal spline 68, which is engaged by a lug means, such as an outwardly extending lug or external spline 70 on upper mandrel 38. It will thus be seen that relative rotation between housing assembly 22 and operating mandrel assembly 32 is prevented. In the run-in position shown in FIGS. 2A–2G, an upper edge or side 72 of lug 70 is positioned adjacent to a downwardly facing annular shoulder 74 in hydraulic body 46. An annulus 75 is defined between hydraulic body 46 and upper mandrel 38 adjacent to slot 68 and lug 70.

The lower end of upper mandrel 38 is attached to a balancing coupling 76 at threaded connection 78. A sealing means, such as O-ring 80, provides sealing engagement therebetween.

Coupling 76 defines a longitudinal passageway 82 therethrough which is in communication with annulus 75. Coupling 76 has an outside diameter 84.

The lower end of hydraulic body 46 is attached to an upper body 86 at threaded connection 88. A sealing means, such as O-ring 90, provides sealing engagement therebetween.

Figure 2C:
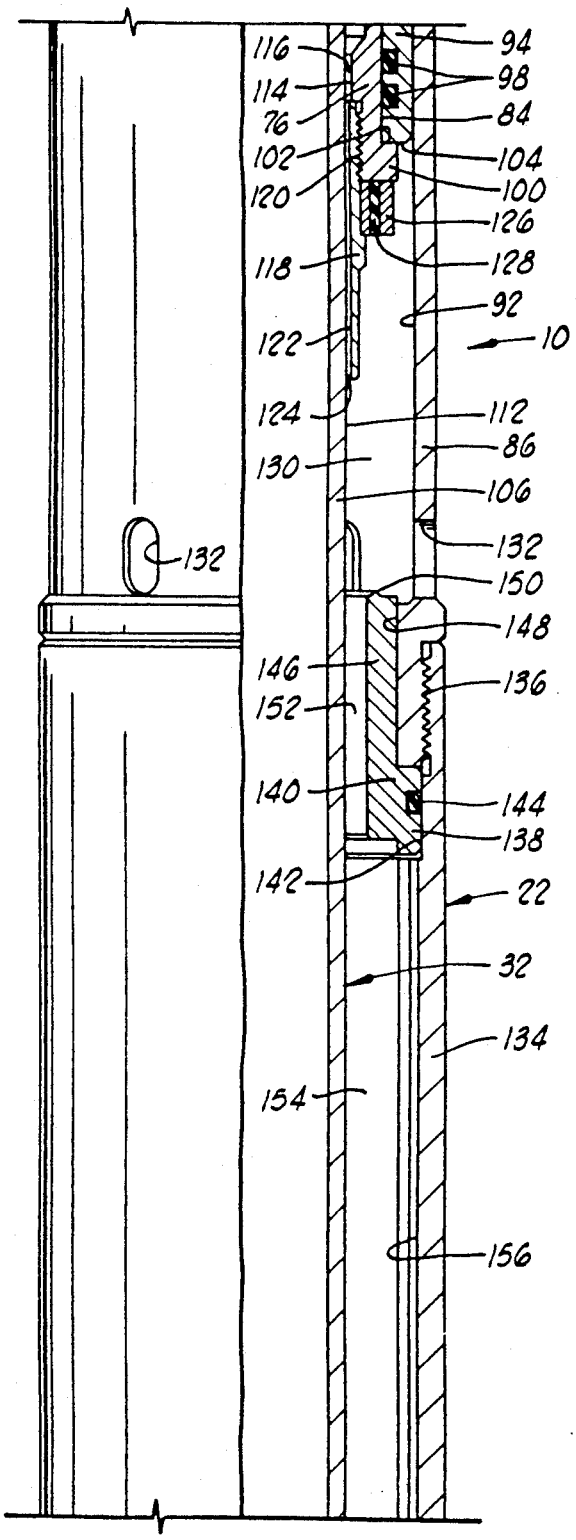

Upper body 86 defines a first bore 92 therein which is spaced radially outwardly from outside diameter 84 of balancing coupling 76. Disposed between first bore 92 and outside diameter 84 is a floating piston 94. Piston 94 is adapted for relative sliding engagement with first bore 92 and outside diameter 84. An outer sealing means, such as O-rings 96, provide sealing between piston 94 and first bore 92 of upper body 86. Referring now to FIG. 2C, an inner sealing means, such as O-rings 98, provides sealing between piston 94 and outside diameter 84 of balancing coupling 76. An enlarged portion 100 of coupling 76 defines an upwardly facing shoulder 102 thereon which is initially positioned adjacent to lower end 104 of piston 94.

Referring to FIGS. 2B and 2C, balancing coupling 76 is attached to a center mandrel 106 at threaded connection 108. A sealing means, such as O-ring 110, provides sealing engagement between the center mandrel and balancing coupling. Center mandrel 106 has a first outside diameter 112.

Balancing coupling 76 has a bore 114 therethrough which is spaced radially outwardly from first outside diameter 112 of center mandrel 106 such that an annulus 116 is defined therebetween. It will be seen that annulus 116 is in communication with passageway 82 in balancing coupling 76.

A seal ring retainer 118 is attached to the lower end of balancing coupling 76 at threaded connection 120. Retainer 118 defines a bore 122 therethrough which is spaced radially outwardly from first outside diameter 112 of center mandrel 106 such that an annulus 124 is defined therebetween which, as will be seen by those skilled in the art, is in communication with annulus 116.

Seal ring retainer 118 holds a bypass seal 126 adjacent to enlarged portion 100 of balancing coupling 76. Bypass seal 126 has an annular sealing element 128 made of elastomeric material or the like.

First bore 92 in upper body 86 is spaced radially outwardly from first outside diameter 112 of center mandrel 106 such that a generally annular cavity 130 is defined therebetween below piston 94. Upper body 86 defines a plurality of transverse bypass ports or openings 132 therethrough which provide communication between cavity 130 and well annulus 133 (see also FIG. 1). As will be further discussed herein, openings 132 form the upper portion of a fluid bypass used when running packer 10 into well bore 12.

The lower end of upper body 86 is connected to packer coupling 134 at threaded connection 136.

A flange portion 138 of a face seal sleeve 140 is positioned in first bore 142 of packer coupling 134. A sealing means, such as O-ring 144, provides sealing engagement between face seal sleeve 140 and the packer coupling. An upper portion 146 of face seal sleeve 140 extends upwardly in second bore 148 of upper body 86. An annular knife edge seat 150 faces upwardly from the top of face seal sleeve 140 and is adapted for sealing engagement by sealing element 128 of bypass seal 126, as will be further described herein.

An annulus 152 is defined between face seal sleeve 140 and center mandrel 106, and a larger annulus 154 is defined between packer coupling 134 and center mandrel 106. It will be seen that both annulus 152 and 154 are in communication with cavity 130.

Figure 2D:
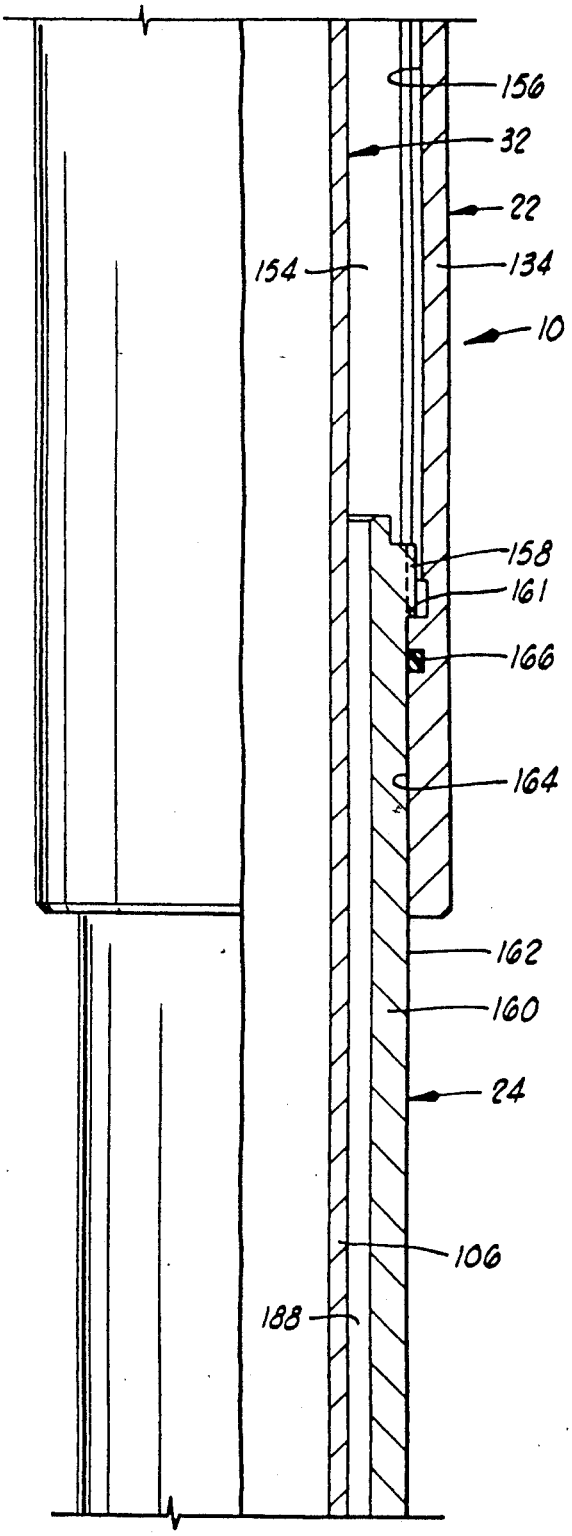

Referring now also to FIG. 2D, a longitudinally extending groove or internal spline 156 is formed in packer coupling 134 and extends downwardly from first bore 142 thereof. A lug receiving means, such as groove or internal spline 156, is engaged by a lug means, such as a lug or external spline 158, on the upper end of shoe mandrel 160. At the lower end of groove 156 is an upwardly facing shoulder 161. Shoe mandrel 160 is part of packer mandrel assembly 24 and has a first outside diameter 162 which is in close, sliding relationship with second bore 164 in packer coupling 134. A slidable sealing means, such as O-ring 166, provides sliding, sealing engagement between shoe mandrel 160 and packer coupling 134. It will be seen that the engagement of lug 158 with groove 156 allows a sliding relationship between shoe mandrel 160 and packer coupling 134 while preventing relative rotation therebetween.

Figure 2E:
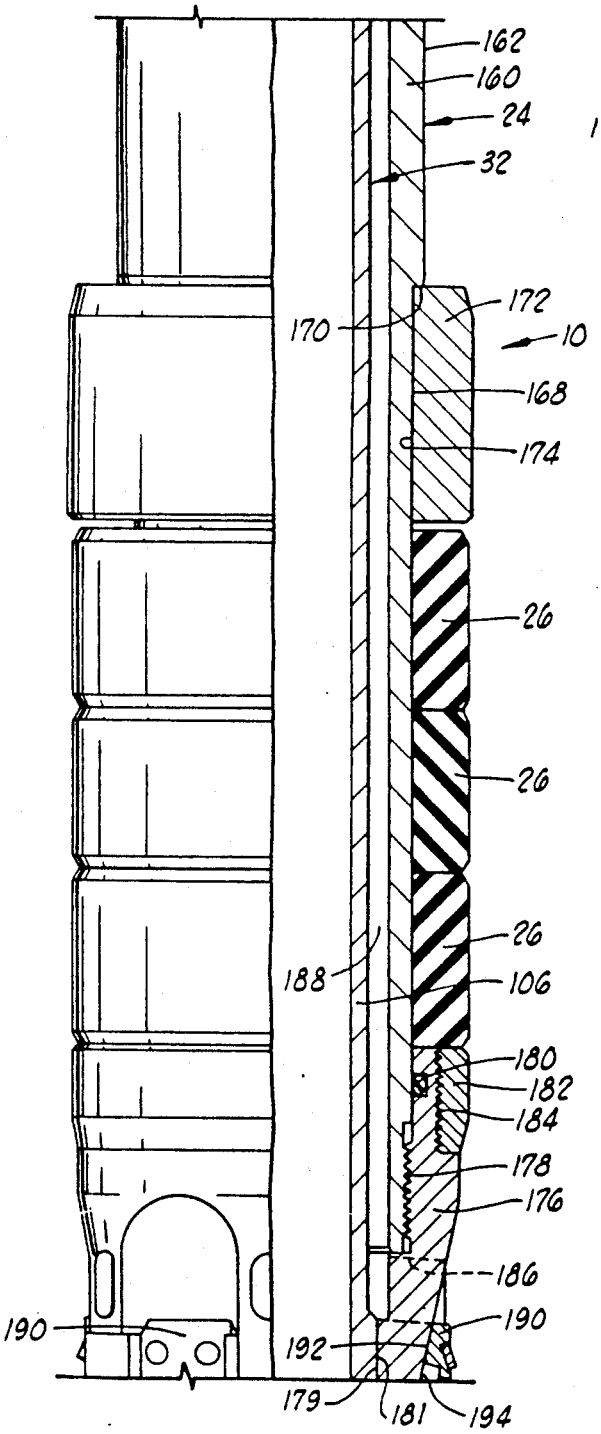

Referring now to FIG. 2E, shoe mandrel 160 has a second outside diameter 168, and a downwardly facing annular shoulder 170 that extends between first outside diameter 162 and second outside diameter 168.

A sliding shoe 172 is disposed on second outside diameter 168 of shoe mandrel 160 and is initially adjacent to shoulder 170. Sliding shoe 172 has a bore 174 therethrough which is in close, but sliding relationship with second outside diameter 168 of shoe mandrel 160.

Packer elements 26 are positioned on second outside diameter 168 of shoe mandrel 160 below sliding shoe 172. Packer elements 26 are of a kind known in the art, and for purposes of illustration, three packer elements are shown.

Below packer elements 26 is a mechanical slip body 176 which is attached to the lower end of shoe mandrel 160 at threaded connection 178. A sealing means, such as O-ring 180, provides sealing engagement between mechanical slip body 176 and shoe mandrel 160. Mechanical slip body has a bore 179 therein which is slidable on second outside diameter 181 of center mandrel 106.

A lower packer shoe 182 is disposed around the upper end of mechanical slip body 176 and is attached thereto by threaded connection 184. It will be seen that packer shoe 182 and the upper end of mechanical slip body 176 are adjacent to the lowermost packer element 26.

Mechanical slip body 176 defines at least one transversely disposed bypass port 186 therein which is in communication with well annulus 133 and an annulus 188 defined between center mandrel 106 and shoe mandrel 160. As shown in FIG. 2D, annulus 188 is in communication with annulus 154. Thus, as will be seen to those skilled in the art, bypass port 186 in mechanical slip body 176 is in fluid communication with bypass port or opening 132 in upper body 86, and there is thus a bypass means in the form of a passageway defined through packer 10.

Figure 2F:
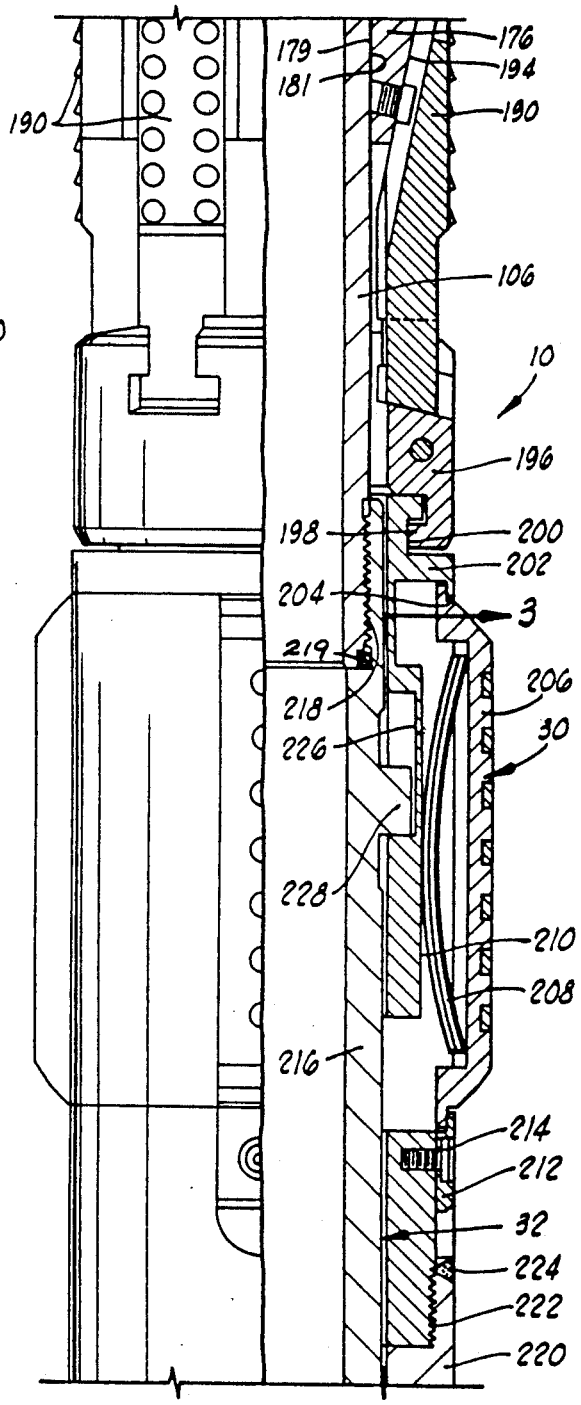

Referring again to FIG. 2E and also to FIG. 2F, a plurality of mechanical slips 190 are disposed around mechanical slip body 176. Each mechanical slip 190 has a tapered upper end 192 which is slidably positioned against tapered surface 194 on mechanical slip body 176. The lower ends of mechanical slips 190 are retained by a split ring collar 196. As will be further discussed herein, mechanical slips 190 are pivotal with respect to collar 196.

At the lower end of collar 196 is an inwardly directed flange portion 198 which engages an annular groove 200 in a drag block sleeve 202. Drag block sleeve 202 forms an upper portion of drag block assembly 30 and defines a plurality of openings 204 therein, and a drag block 206 is disposed in each opening 204. A biasing means, such as a plurality of springs 208, bears against surface 210 in drag block sleeve 202 and biases drag blocks 206 radially outwardly. The lower end of each drag block 206 is retained by a drag block keeper 212 which is held in place by a plurality of bolts 214.

The lower end of center mandrel 106 is connected to a lower mandrel 216 at threaded connection 218. A sealing means, such as O-ring 219, provides sealing engagement between center mandrel 106 and lower mandrel 216.

The lower end of drag block body 202 is attached to a drag block collar 220 at threaded connection 222. Fastening means, such as weld 224, permanently connect drag block sleeve 202 and drag block collar 220.

Figure 2G:
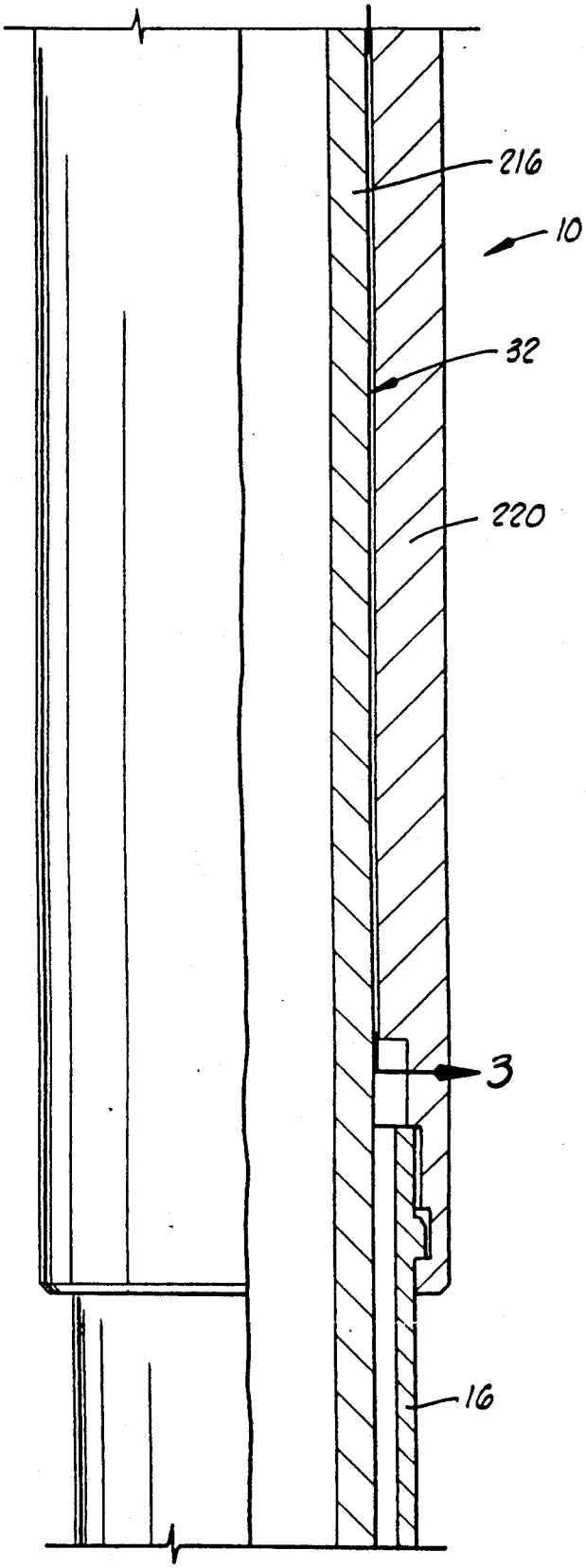

As seen in FIG. 2G, lower mandrel 216 extends downwardly through drag block collar 220. The lower end of drag block collar 220 is adapted for connection to a lower portion of the tool string which includes tool 16.

Figure 3:
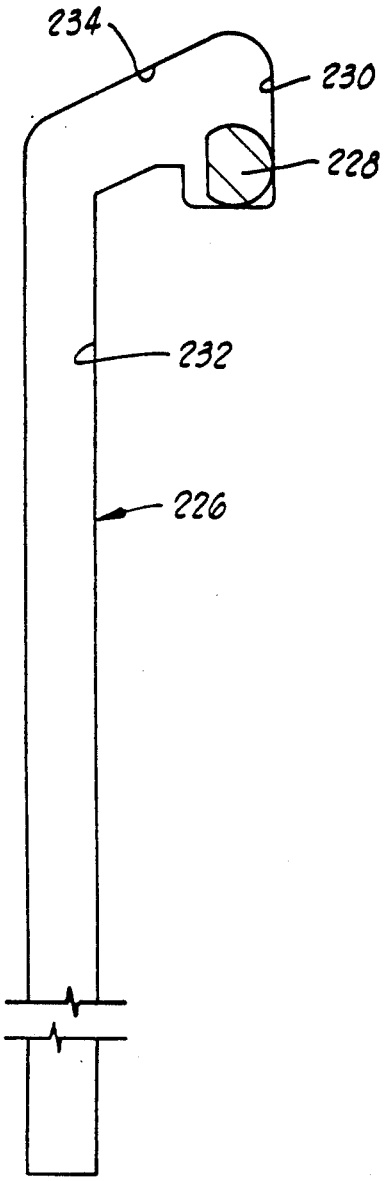
FIG. 3 is a view of a J-slot taken along lines 3—3 which begins in FIG. 2F and extends to FIG. 2G.

Referring to FIGS. 2F, 2G and 3, drag block sleeve 202 and drag block collar 220 define a J-slot 226 therein which is engaged by a lug 228 on lower mandrel 216. J-slot 226 has a short leg 230 and a long leg 232 interconnected by an angled transition portion 234.

Operation Of The Invention

When running tool string 14 into the well bore, fluid is free to enter packer 10 through bypass ports 186, travel through the previously described passageway for discharge through bypass openings 132. Thus, a bypass means is provided for packer 10 to reduce surging as the tool string is run into the well bore. This bypass means is of a kind generally known in the art.

When packer 10 and tool 16 are in the desired position within bore 20 of liner 18, at least a portion of the operating cycle of tool 16 may be carried out. When in liner 18, drag block assembly 30 engages bore 20 such that manipulation of tool string 14, and thus operating mandrel assembly 32, is possible with respect to packer mandrel assembly 24. It will thus be seen by those skilled in the art that by lifting on tool string 14, J-slot lug 228 will be moved upwardly within short leg 230 of J-slot 226. By turning tool string 14 to the right, J-slot lug 228 will be moved through transition portion 234 of J-slot 226 until it is aligned with long leg 232 of the J-slot. At this point, weight may be set down on tool string 14 and operating packer assembly 32 will be moved downwardly with respect to packer mandrel assembly 24 as J-slot lug 228 moves downwardly through long leg 232 of J-slot 226.

As the downward movement of operating mandrel assembly 32 occurs, it will be seen that lug or spline 70 moves downwardly through slot or spline 68, and balancing coupling 76 moves bypass seal 126 downwardly through cavity 130 until sealing element 128 is sealingly engaged with knife edge seat 150 on face seal sleeve 140. Thus, bypass openings 132 are sealingly separated from annulus 152, and the bypass passageway is closed. Floating piston 94 insures that a downward force is maintained on sealing element 128 when packer 10 is set as is known in the art.

When bypass seal 126 engages face seal sleeve 140, further downward movement of operating mandrel assembly 32 will move housing 22 downwardly with respect to packer mandrel assembly 24. Thus, lug or spline 158 on shoe mandrel 160 is moved relatively upwardly within slot or spline 156 in packer coupling 134. O-ring 166 maintains sealing engagement between housing 22 and packer mandrel assembly 24.

Because of the length of shoe mandrel 160 at the upper end of packer mandrel assembly 24, and thus the predetermined amount of sliding engagement between shoe mandrel 160 and packer coupling 134 of housing assembly 22, it will be seen that housing 22 can be moved an appreciable amount longitudinally with respect to packer mandrel assembly 24 before packer coupling 34 can engage sliding shoe 172. This amount of longitudinal movement is sufficient to allow actuation of tool 16 without setting packer 10.

Once the desired cycling of tool 16 has been carried out by reciprocation of tool string 14, operating mandrel assembly 32 may be lowered further such that packer coupling 134 of housing assembly 22 is brought into contact with sliding shoe 172. Further downward movement of tool string 14 thus forces sliding shoe 172 downwardly along shoe mandrel 160, squeezing packer elements 26 so that they are expanded out into sealing engagement with bore 20 in liner 18. At approximately the same time, mechanical slip body 176 is moved downwardly with respect to slips 190 so that slips 190 are pivoted outwardly into gripping engagement with the well bore as is known in the art. Thus, packer 10 is set into gripping and sealing engagement with liner 18, and well annulus 133 is closed off.

If pressure builds up below packer 10, this pressure is transmitted through bypass ports 186 in mechanical slip body 176, through annuli 188, 154, 152 and 116, passageway 82, and annulus 75. Thus, the pressure below packer 10 is transmitted to hydraulic slips 58, forcing the hydraulic slips outwardly into gripping engagement with the well bore so that packer 10 cannot be pumped upwardly once set.

When it is desired to release packer 10, weight is picked up on tool string 14, and operating mandrel assembly 32 is thus lifted. Upper side 72 of lug 70 is brought into engagement with shoulder 74 in hydraulic body 46, thus raising housing assembly 22. Raising housing assembly 22 relieves the downward force on sliding shoe 172 which takes the squeezing load off packer elements 26 so that they will return to their initial, unsealed position. Further raising of housing 22 causes lug 158 to engage shoulder 161 at the lower end of groove 156 so that packer mandrel assembly 24 is lifted. As is known in the art, this releases mechanical slips 190 from gripping engagement with liner 18. At this point, the entire tool string may be raised from well bore 12.

It will be seen, therefore, that the long stroke packer of the present invention is well adapted to carry out the ends and advantages mentioned as well as those inherent therein. While a presently preferred embodiment of the apparatus has been shown for the purposes of this disclosure, numerous changes in the arrangement and construction of parts may be made by those skilled in the art.

What is claimed is:

1. A packer for use in a well bore, said packer comprising:

a housing;

a packer mandrel slidably disposed with respect to said housing;

an operating mandrel slidably disposed in said housing and packer mandrel and adapted for connection to a tool string;

packer means disposed on said packer mandrel for sealingly engaging said well bore when in a set position; and a packer shoe slidably disposed on said packer mandrel between said housing and packer means, said shoe being initially spaced from said housing, wherein during a setting operation, said packer shoe is contacted by said housing such that said shoe is moved against said packer means for setting thereof.

2. The packer of claim 1 further comprising means preventing relative rotation between said housing and packer mandrel.

3. The packer of claim 2 wherein said means for preventing relative rotation comprises:

one of said housing and said packer mandrel comprise lug means for extending therefrom; and the other of said housing and said packer comprise receiving means for receiving said lug means therein and providing sliding engagement therebetween.

4. The packer of claim 3 wherein:

said lug means extends radially outwardly from said packer mandrel; and said receiving means is on said housing.

5. The packer of claim 1 wherein said housing and packer mandrel are relatively longitudinally slidable a predetermined amount before said housing can contact said shoe.

6. The packer of claim 1 wherein said packer mandrel comprises a shoulder adjacent to said shoe so that relative upward movement thereof is prevented beyond said shoulder.

7. The packer of claim 1 further comprising a mechanical slip means for grippingly engaging said well bore when in a set position.

8. The packer of claim 1 further comprising a drag block for engaging a liner portion of said well bore and allowing relative movement between said housing and said operating mandrel.

9. The packer of claim 8 further comprising:

a J-slot at least partially defined in said drag block; and a J-slot lug extending from said operating mandrel and engaging said J-slot.

10. The packer of claim 1 wherein said shoe is positioned adjacent to said packer means.

11. The packer of claim 1 further comprising bypass means for bypassing fluid when the packer is run into said well bore.

12. A downhole tool comprising:

a fracturing tool having an operating cycle; and a packer disposed above said fracturing tool, said packer comprising:

a housing;

a packer mandrel slidably disposed with respect to said housing;

an operating mandrel slidably disposed in said housing and packer mandrel;

packer means disposed on said packer mandrel for sealingly engaged said well bore when said packer is in a set position; and a slidable packer shoe disposed adjacent to said packer mandrel such that said shoe is contacted by a portion of said housing and moved against said packer means during a setting operation, said housing being slidable a predetermined amount without contacting said shoe;

wherein:

said operating mandrel is reciprocable an amount sufficient for cycling said fracturing tool without setting said packer; and said operating mandrel is further reciprocable for placing said packer in said set position.

13. The tool of claim 12 further comprising sealing means for sealing between said housing and packer mandrel.

14. The tool of claim 12 wherein said operating mandrel is further reciprocable for releasing said packer from said set position.

15. The tool of claim 12 wherein said packer mandrel comprises a shoulder adjacent to said shoe such that relative upward movement of said shoe with respect to said packer mandrel is prevented.

16. The tool of claim 15 wherein said shoe is between said shoulder and packer means.

17. The tool of claim 12 further comprising means for preventing relative rotation between said packer mandrel and said housing.

18. The tool of claim 15 wherein said means is characterized by:

one of said housing and said packer mandrel having a lug means for extending therefrom; and the other of said housing and said packer mandrel having lug receiving means thereon for receiving said lug means.

* * * * *